US005983793A

United States Patent [19]

Volz et al.

[11] Patent Number: 5,983,793

[45] Date of Patent: Nov. 16, 1999

[54] DRIVE FOR A SHEET-FED PRINTING MACHINE

[75] Inventors: Albrecht Volz, Rodermark; Joachim Blumor, Hainburg; Klaus-Peter Reichardt, Bad Vibel; Holger Wiese, Obertshausen; Helmut Schild, Steinbach, all of Germany

[73] Assignee: MAN Roland Druckmaschinen AG, Germany

[21] Appl. No.: 08/942,994

[22] Filed: Oct. 2, 1997

[30] Foreign Application Priority Data

Oct. 2, 1996 [DE] Germany ..... 196 40 649

[51] Int. Cl.[6] ..... B41F 5/00

[52] U.S. Cl. ..... 101/216; 101/218; 101/247; 101/248; 101/477

[58] Field of Search ..... 101/130, 132, 101/132.5, 136, 137, 141, 142, 144, 145, 147, 177, 183, 184, 185, 216, 217, 218, 230, 232, 247, 248, 425, 450.1, 477, 492, 348

[56] References Cited

U.S. PATENT DOCUMENTS

| | | | |
|---|---|---|---|
| 3,742,849 | 7/1973 | Greiner et al. | 101/248 |
| 4,000,692 | 1/1977 | Wirz et al. | 101/218 |
| 4,214,526 | 7/1980 | Jeschke | 101/216 |
| 4,353,299 | 10/1982 | Murai et al. | 101/425 |
| 4,833,486 | 5/1989 | Zerillo | 101/450.1 |
| 4,936,215 | 6/1990 | Walker et al. | 101/247 |
| 5,194,881 | 3/1993 | Hirt | 101/463.1 |
| 5,377,589 | 1/1995 | Krüger et al. | 101/216 |
| 5,586,499 | 12/1996 | Beaumont et al. | 101/183 |
| 5,596,931 | 1/1997 | Rösler et al. | 101/216 |

FOREIGN PATENT DOCUMENTS

| | | |
|---|---|---|
| 41 02 472 A1 | 8/1992 | Germany . |
| 42 23 583 A1 | 1/1994 | Germany . |
| 42 41 807 A1 | 6/1994 | Germany . |
| 44 12 047 A1 | 10/1995 | Germany . |

*Primary Examiner*—Eugene Eickholt
*Attorney, Agent, or Firm*—Leydig, Voit & Mayer, Ltd.

[57] ABSTRACT

A drive for a sheet-fed printing machine, in particular a sheet-fed offset printing machine is described, in which the individual cylinders and/or drums and the plate or form cylinders are driven by a common drive train. In order to allow automated operations to proceed simultaneously, clutches are arranged in the drive trains of the individual plate or form cylinders and, furthermore, the individual plate or form cylinders are assigned drive motors which can be controlled separately and by means of which the plate or form cylinders can be driven in the intended manner after corresponding disengagement.

12 Claims, 3 Drawing Sheets

DRIVE FOR A SHEET-FED PRINTING MACHINE

TECHNICAL FIELD

The invention relates to a drive for a sheet-fed printing machine and, in particular, an offset printing machine in which the individual drums and/or cylinders share a common drive.

BACKGROUND

In sheet-fed printing machines and, in particular, sheet-fed offset printing machines of the type which is nowadays widespread, the drive is usually effected by means of one or more controlled drive motors onto a common, continuous train of gears which connects together the cylinders in the individual printing units and the transfer drums arranged between the printing units. In this case, a longitudinal shaft may additionally also be provided to reinforce this transmission train, by means of which shaft the driving output is introduced into the train of gears at several points via corresponding transmissions. Drive systems of this type are distinguished by their high printing quality, which is due to the highly synchronous functioning of the various printing units of the printing machine resulting from the rigid interconnection provided by the drive train. In this case, the required high rigidity in the train of driving gears serves, in particular, to avoid the so-called ghosting which occurs particularly when the rotational speed is changed.

A disadvantage in sheet-fed offset printing machines, in which the individual cylinders and the transfer drums arranged between the printing units are driven together with one another by means of a common train of gears, is that any automated operations to be completed outside the printing operation have to be carried out one after another. Sheet-fed offset printing machines, in particular, are increasingly being fitted with automatic washing devices for the blanket cylinders and/or the back pressure cylinders. It is also possible for washing devices to be provided for the rollers of the inking and/or damping unit. In order to achieve optimum washing results in each case on the different cylinders or rollers, in particular with the furthest possible reduction in the consumption and waste of detergent, individual control of the respective washing operations is required (e.g., number of revolutions and direction of rotation of the cylinders) during a washing operation (i.e., engagement and disengagement of the washing device to and from the cylinder to be cleaned). Individualized control operations, particularly in washing operations, therefore require the individual processes (e.g., the preparation of a new print order or during the execution of a print order), to be carried out one after another. The exchange of the printing plates for the preparation of a new print order should also be mentioned, since movements determined by the machine or the plate or form cylinders in the individual printing units in the sense of moving to predetermined positions have to be carried out as well as displacement by predetermined paths or angles.

In view of the foregoing, for the preparation of a new print order or while an existing print order is being carried out, a specific number of machine revolutions at correspondingly predetermined rotational speeds is always required in order to be able to carry out the required operations. Owing to the number of machine revolutions which in some cases cancel each other out or directions of rotation which may also cancel each other out in specific processes, the operations can consequently only be carried out one after another, so that in total a correspondingly high number of machine revolutions occurs and the time required to carry out the processes becomes correspondingly long.

Furthermore, the changes in format or the exchange of the printing material in the feeder and deliverer of the sheet-fed offset printing machine should also be mentioned. The feeder of a sheet-fed offset printing machine usually has a controllable clutch, by means of which the movement of the members bringing about the pickup of the sheets from the top of the pile and the conveying of the sheets to the feeder can be disengaged. Furthermore, a clutch arranged on the feeder drum is also known from DE 4 412 047 A1, by means of which both the said drum and the entire sheet conveying and delivery device arranged downstream of the drum can be disengaged. Although these previously known devices make it possible for the machine to continue rotating during a pile exchange in the feeder and deliverer (e.g. for a washing operation), this does not result in any further flexibility in terms of processes to be carried out simultaneously.

Similar to the prior art cited above, it is known from DE 4 102 472 A1 to individually drive the assemblies (i.e., feeder, printing units, deliverer) by means of separate. This previously known rotary printing machine avoids the effects of load fluctuations caused by the different assemblies, which effects leave a negative impression in the printing result.

A drive for a printing machine is known from DE 4 241 807 A1, in which a first drive is provided solely for all the cylinders serving to convey the printing material and for the plate cylinders, and drives the said cylinders by means of a continuous train of gears. Furthermore, at least one further drive is provided for the elements which do not serve to convey the printing material, each drive containing at least one motor, and transmitters for the movement parameters being provided, which are connected to a control and regulation device. In this case, this previously known drive arrangement is intended to help reduce the de-synchronizing influence exerted by the drive train of the elements that do not convey the printing material. Even in this type of device, however, the cylinders within the individual printing units and the cylinders or drums between them are connected together by means of a common train of gears. Thus, the disadvantages mentioned above remain in terms of the automated washing or the exchange of printing plates.

It is furthermore known in sheet-fed offset printing machines to design the plate or form cylinders to be remotely adjustable, to adjust the circumferential registration, in relation to the blanket cylinder which interacts with the plate or form cylinder. Devices for adjusting the circumferential registration, however, only permit small adjustments of the cylinder. With such devices, it is not possible to rotate the cylinder freely in relation to the gear wheel assigned to it. The same applies to the positioning motors which are assigned to the devices for adjusting the circumferential registration and can likewise only rotate the plate or form cylinder by predetermined distances or angular amounts. Coarse setting devices for the circumferential registration allow the plate or form cylinder to be released from the gear wheel assigned to it by manual loosening of screws and relatively large angular rotatation relative to the gear wheel. These devices are intended, in particular, to make possible large corrections in the circumferential registration or such corrections to overcome an incorrect plate copy with respect to the feed edge of a print. Adjusting devices of this type, however, require manual handling for the loosening and tightening of the connection, which is secured against rotation, between the driving gear wheel and the cylinder body. Furthermore, the adjustment of the cylinder by the appropriate distance or angular amount also has to be carried out by hand, using a special tool.

SUMMARY OF THE INVENTION

The object of the present invention is therefore to develop a drive for a sheet-fed printing machine that, while avoiding the disadvantages mentioned above, has a high degree of flexibility in terms of the processes it may carry out simultaneously or at least offset in phase relative to one another.

According to the invention, plate or form cylinders of a printing machine are connected and driven by a common train of gears, with each of the individual printing units having a clutch for de-coupling the unit from the drive train, thus allowing an individual plate or form cylinder to be rotated freely by assigned drivers. According to a further aspect of the invention, provision is made for the rollers of the inking and/or damping units of each printing unit, which interact with the plate or form cylinders, to be connected directly to the plate or form cylinder by means of continuous trains of gears, so that these rollers are also rotated when the respective plate or form cylinder is being driven.

In an offset printing machine fitted with a drive of this type, it is possible, for the preparation of a new print order, to carry out the exchange of the printing plates in all the printing units at the same time as washing operations for the blanket cylinders and/or the back pressure cylinders. For this purpose, the clutches assigned to the individual plate or form cylinders are first actuated, so that the connection, which is secure against rotation, between the respective plate or form cylinders and the assigned gear wheels is canceled and the plate or form cylinders can thus be freely rotated and positioned in relation to the remaining cylinders by means of the respectively assigned drives. It is then possible, by means of devices mounted on the individual printing units, in particular for the automatic printing plate exchange (automatic removal of the used printing plate and automatic supply of a new printing plate for the respective plate or form cylinder), to carry out the exchange of the individual printing plates simultaneously in the individual printing units.

While, after activation of the clutches, provided according to the invention, of the individual plate or form cylinders and corresponding control of the assigned drives, the printing plates are being exchanged, it is possible to wash the blanket cylinders and/or back pressure cylinders automatically by means of the washing devices arranged in the individual printing units for any desired number of machine revolutions in any desired direction of rotation of the cylinders. Furthermore, by disengaging the plate or form cylinders, it is possible to completely disengage the main drive, for example for a pile or plate exchange in the feeder and deliverer or other measures in the region of these assemblies. Since in this case only the plate or form cylinders carry out corresponding movements, it is also possible for specific maintenance work to be carried out on the remaining cylinders by opening the appropriate guards. After the main drive has been disengaged, it is also possible during the automated exchange of the printing plates of the individual plate or form cylinders to mount special dressings, for example on sheet transfer drums, to avoid any smearing of freshly printed sheets. This also requires the guards arranged between the printing units to be opened, whereupon, for reasons of operator protection, the drive may only carry out specific commands (e.g., tipping forward, limited path; tipping back, limited path).

By means of the clutches, assigned to the individual plate or form cylinders, washing of the rollers of the inking and/or damping unit can proceed at the same time as other automated processes (e.g., washing of the blanket cylinders/washing of the back pressure cylinders). Furthermore, by proceeding with disengaging individually driven plate or form cylinders, pre-damping or pre-inking may occur during a washing operation for the preparation of a new print order or for the reduction of waste during the start-up or restarting of the machine, while an existing print order is being carried out. The plate or form cylinders which are disengaged from the continuous train of gears and are driven individually in addition to the rollers of the inking and/or damping unit can then be driven individually at appropriate rotational speeds to maintain an existing or set up a new thickness gradient of the ink film.

A further advantage of the invention is realized when so-called printing image producing devices are assigned to the plate or form cylinders in the individual printing units, by means of which devices a printing form can be produced by direct processing of digital image data. On completion of a previous print order, while the blanket cylinders and/or back pressure cylinders are being washed by washing devices via corresponding command procedures of the control arranged upstream of the main drive, the forms located on the form cylinders can already be newly printed in the individual printing units, as is similarly the case with the automatic exchange of the printing plates or printing forms. In keeping with the invention, the deletion or removal of a printing form used for the previous print order and not required for the next run can be carried out while further operations, for example cylinder washing, are being carried out.

According to one important aspect of the invention, the individual plate or form cylinders are associated with clutches that are remotely actuable and by means of which the fixed drive coupling between the plate or form cylinder and the blanket cylinder, which interacts with it, can be temporarily varied. The clutches may be frictional or positive-locking clutches which, in the coupled state, bring about a connection sufficient to secure against relative rotation between the driving gear wheel of the plate or form cylinder and the body of the cylinder. In order to reinstate the connection between the driving gear wheel and the cylinder body, the respective cylinder assumes an appropriate orientation relative to the gear wheel. This proper registration of the cylinder can be accomplished in several ways. For example, an index clutch can used, which allows the coupling of the parts to occur only in one position relative to one another. Consequently, for re-engaging, the drive assigned to the plate or form cylinder moves the cylinder body into an appropriately provided position and the clutch is then actuated.

In the case of the drives assigned to the individual plate or form cylinders, these are preferably conventional position-controlled motors, in particular positioning drives. In this case, the positioning resolution of the positioning drives is such so as to provide the required accuracy for carrying out the individual processes (e.g., plate exchange or printing on a printing form). A further requirement of the drives or positioning motors is they must be able to rotate the plate or form cylinders at the speed necessary for carrying out specific processes.

According to one aspect of the invention, the drives are preferably connected to the individual plate or form cylinders by means of reducing gears. This construction requires these drives to rotate freely during normal printing operation, that is with a connection between the driving gear wheel of the plate or form cylinder and the cylinder body.

In a further embodiment of the invention, this accompanying rotation of these drives takes place without power, i.e. the individual drives are switched to be free from torque. Also, a controllable power supply for the drives may be used during the printing operation to exert braking moments on the plate or form cylinder of a predetermined type and magnitude for the purpose of achieving a uniform tooth flank contact in the trains of gears between the plate or form cylinder and the blanket cylinder and between the blanket cylinder and the back pressure cylinder.

In a still further aspect of the invention, additionally controllable clutches may be provided in the transmission train to couple the drives to the individual plate or form cylinders, so that the drives themselves can also be disengaged during the printing operation.

The plate or form cylinders that are provided with a clutch and an individually controllable drive are separable from the blanket cylinder which interacts with them. To switch to printing in a sheet-fed offset printing machine, the blanket cylinders are separable both from the back pressure and the plate or form cylinders by means of eccentric bearings. In order to achieve larger separating points between the plate or form cylinder or the blanket cylinder which interacts with it (print off), means are provided to appropriately control a device for adjusting the printing thickness of the plate or form cylinder and to position the latter at an even greater distance from the blanket cylinder. Printing positioning devices of this type are well know and generally present in the plate or form cylinders of sheet-fed offset printing machines.

BRIEF DESCRIPTION OF THE DRAWINGS

The explanation of an exemplary embodiment of the invention follows with reference to the following figures below.

DETAILED DESCRIPTION OF THE ILLUSTRATED EMBODIMENT

Figure 1:
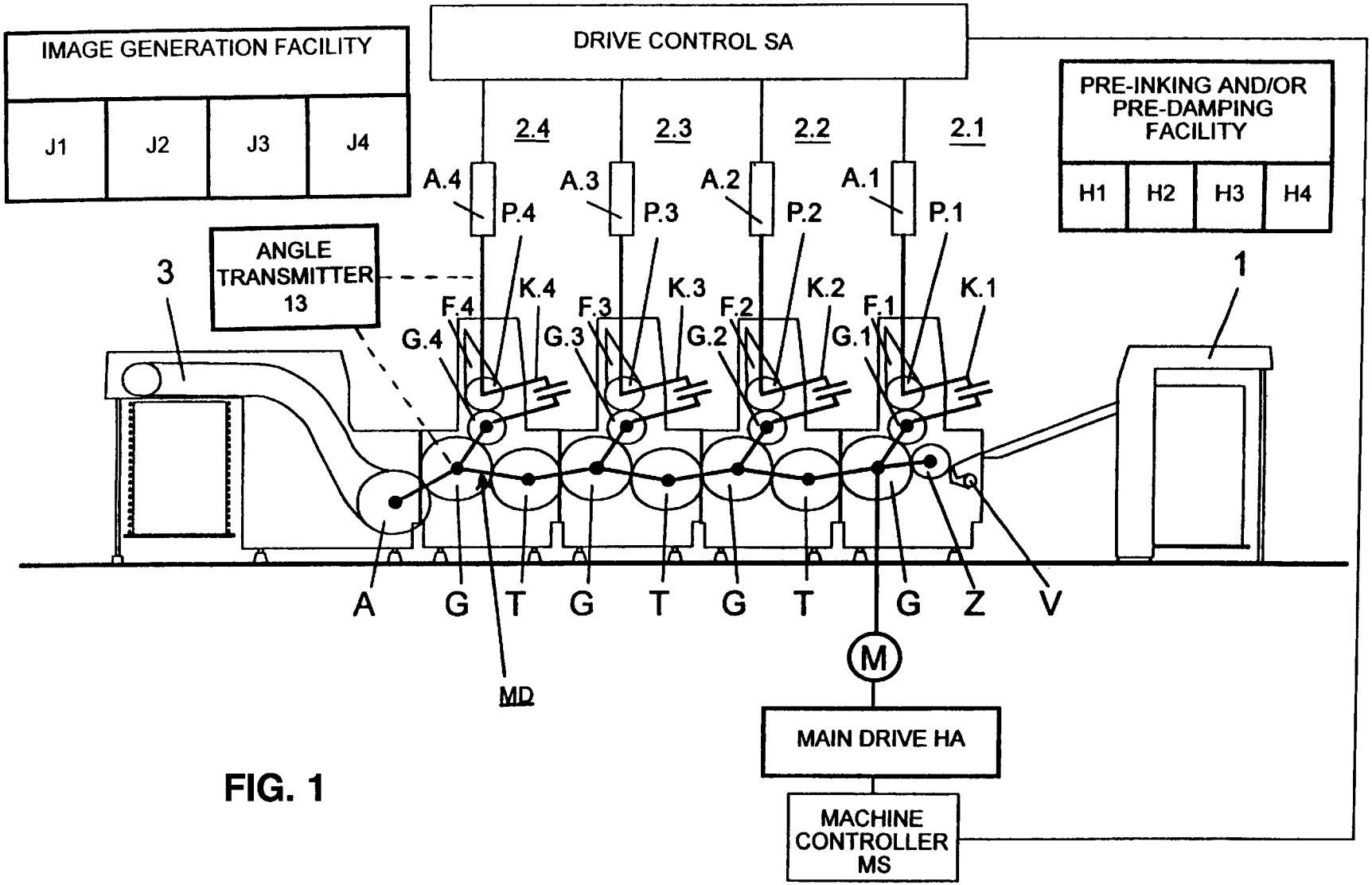
FIG. 1 illustrates a printing machine having a plurality of printing units commonly driven through a single drive train in keeping with the invention, where th printing machine includes facilities for auxiliary functions that may be accomplished off-line and independent of one another.

Turning to the drawings and referring to FIG. 1, a sheet-fed offset printing machine has four printing units 2.1 to 2.4 in addition to a feeder 1 and deliverer 3. In the printing units 2.1 to 2.4, the plate or form cylinders P.1 to P.4 are assigned rollers of inking and/or damping units F.1 F.4 which are driven by the respective plate or form cylinders P.1–P.4. Conventional auxiliary functions for the printing machine are represented in the illustration of FIG. 1 by the image generation facility comprising sections J1 through J4 for each of the printing units 2.1 through 2.4, respectively, and a conventional pre-inking and/or pre-damping facility likewise comprising sections H1 through H4 for each of the printing units 2.1 through 2.4, respectively.

A continuous train of gears MD, indicated in FIG. 1 and powered by a motor M and main drive HA, drives the plate or form cylinders P.1–P.4 arranged in the printing units 2.1 to 2.4 of the blanket cylinders G.1 to G.4, the back pressure cylinders G, the transfer drum T arranged between the printing units, the feed drum Z, the pregripper V and the delivery drum A assigned to the deliverer 3. The main drive HA of the drive motor M for the continuous train of gears MD is in communication with a machine controller MS, which commands the movements of the machine in a predetermined manner that are stored in a memory and triggered manually. The machine controller MS is also in connection with guard elements (not shown here), operating keys on individual printing units and a machine control panel, by means of which the controller's state of actuation can be recorded and, correspondingly, a release or intended limitation of implementable movement commands takes place.

In the individual printing units 2.1 to 2.4, one of the clutches K.1 to K.4 is arranged between the plate or form cylinders P.1 to P.4, and the blanket cylinders G.1 to G.4. The clutches allow the plate or form cylinders P.1 to P.4 to be disengaged from the movement of the remaining cylinders or drums V, Z, G, G.1–G.4 and A when the blanket cylinders G.1 to G.4 are not engaged. Thus, the drive motor M of the main drive HA drives the blanket cylinders G.1 to G.4 in the individual printing units 2.1 to 2.4 while the plate or form cylinders P.1 to P.4 are stationary.

Assigned to the individual plate or form cylinders P.1 to P.4 in the individual printing units 2.1 to 2.4 are additional drives A.1 to A.4, by means of which the plate or form cylinders P.1 to P.4 can be driven individually when the clutches K.1 to K.4 have been disengaged. In this case, the clutches K.1 to K.4 and the drives A.1 to A.4 of the plate or form cylinders P.1 to P.4 are in communication with a drive control SA that may also be a part of the machine control MS. For reasons of clarity, however, the drive control SA is illustrated as a separate control with a corresponding connection to the machine control MS.

Specific programs for moving the plate or form cylinders P.1 to P.4 to specific positions are stored in the drive control SA within a program memory 11—e.g., the automatic exchange of the printing plates/printing forms of the plate or form cylinders P.1 to P.4 and the pre-inking or pre-damping of the cylinders of the inking and/or damping units F.1 to F.4. In keeping with the invention, these programs in the program memory 11 include commands for the individual clutches K.1 to K.4 and the drives A.1 to A.4. On the other hand, programs for achieving intended movement sequences, in particular for the automatic washing of the blanket cylinders G.1 to G.4 and of the back pressure cylinders G and possibly also of the transfer drums T or the sheet guiding paths assigned to them, are preferrably stored in the machine control MS.

The control of the drives A.1 to A.4 is a function of the engagement states of the clutches K.1 to K.4 and it is accomplished by the drive control SA. The drive control SA individually controls the drives A.1 to A.4 and the clutches K.1 to K.4 assigned to their respective plate or form cylinders P.1 to P.4. Provision is also made for moving to specific positions not only for the automatic exchange of printing plates, but additionally also moving to predetermined positions the remaining printing units cylinders, preferably in conjunction with a positioning interrogation by an angle transmitter 13 via the machine control MS, for the re-engagement of the plate or form cylinders P.1 to P.4 by means of the clutches K.1 to K.4 such that that printing machine returns to operation with proper registration of all of the cylinders in all of the units.

Figure 2:
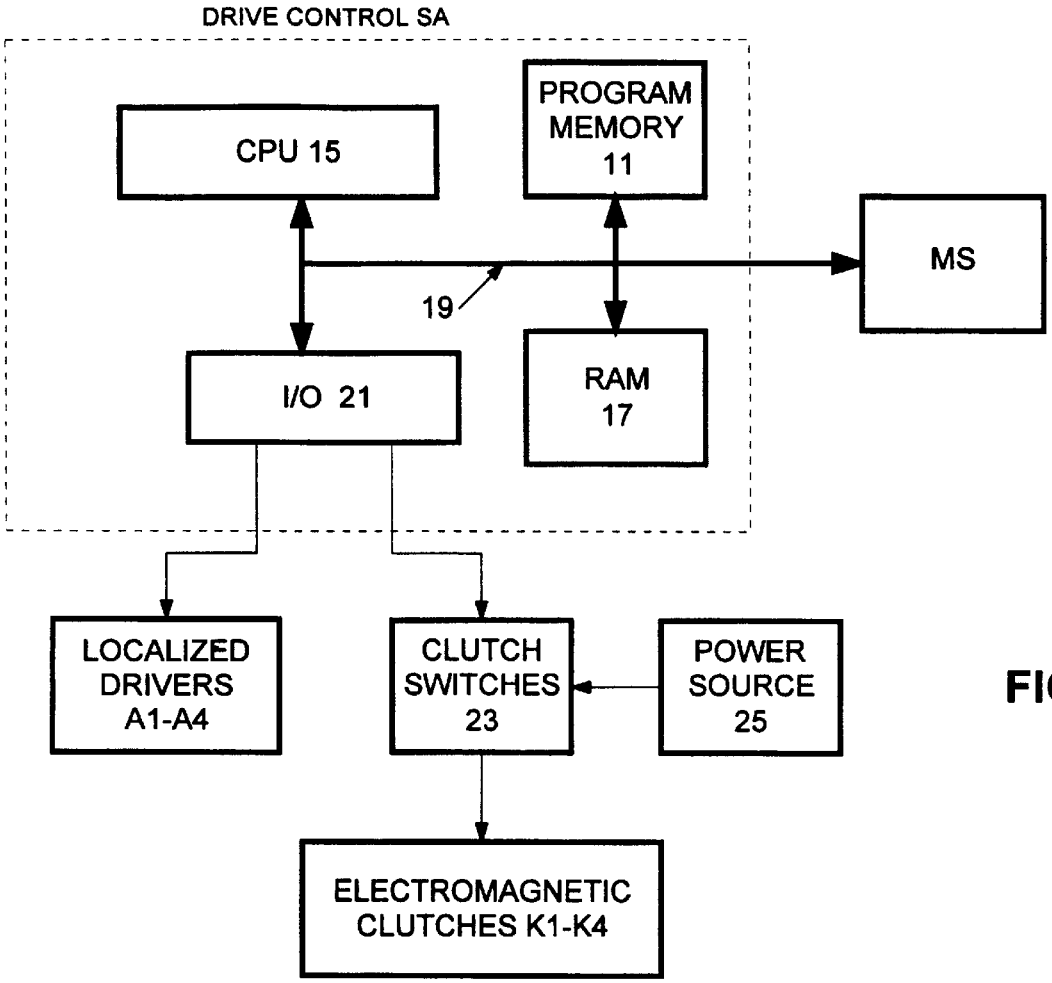
FIG. 2 illustrates the control system for the printing machine in FIG. 1 for enabling the independent functions.

Turning to FIG. 2, the drive control SA includes a central processing unit (CPU) 15 in communication with the program memory 11 and RAM 17 via a conventional bus architecture 19. The CPU 15 is in communication with the localized drivers A.1–A.4 and the clutches K.1–K.4 by way of a conventional input/output 21. Although it is not illustrated in FIG. 2, those skilled in the art will appreciate that conventional buffer circuitry may be employed to communicate the signals from the input/output 21 to each of the localized drivers A.1–A.4 and the clutches K.1–K4.

In the illustrated embodiment, the clutches K.1–K.4 are electromagnetic clutches that are controlled by switches 23, which are in turn are controlled by the drive control SA. The switches 23 may be relays that function to control the application of energy to the clutches from a power source 25. Each of the electromagnetic clutches K.1–K.4 is associated with one or more of the switches 23 such that an open condition of the associated switch or switches de-energizes the clutch. The de-energization of the clutches may be either couple to or de-couple from the main drive MD, depending on the mechanical biasing of the clutches.

In keeping with the invention, the program memory 11 of the drive control SA stores routines that are executed by the localized drivers A1 through A4 after the clutches K.1–K.4 have brought the cylinders or rollers off-line. In this manner, the cylinders or rollers are de-coupled from the main drive train MD and can perform various functions independent of the operation of other cylinders or rollers in the same and other printing units 2.1–2.4. T his allows, for example, a pre-inking or washing function to be executed by the driver A1–A4 for one of the printing units 2.1–2.4 while another driver controls the production of a new printing form for the unit. Without the ability to de-couple various cylinders in each of the printing units 2.1–2.4, these functions could not be carried out substantially simultaneously. Instead, they would be carried out in a timed sequential manner that is time consuming and cumbersome.

Figure 3:
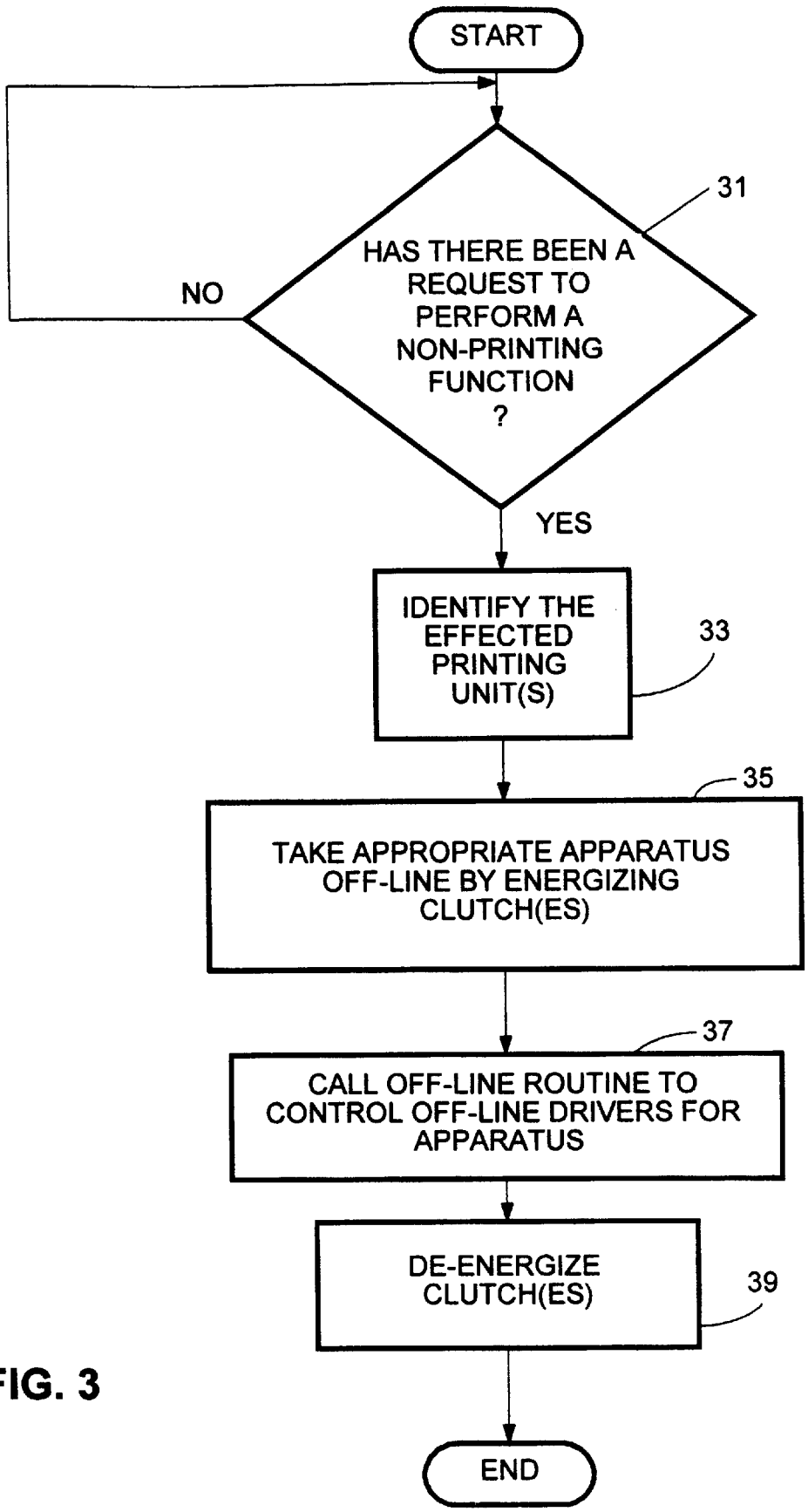
FIG. 3 is a flow diagram illustrating the process in keeping with the invention for the controlled execution of the auxiliary functions by a portion of the printing machine independent of the functioning of the remaining portions.

Turning to FIG. 3, the drive control SA receives a request to perform a non-printing function at step 31, which may originate from a user input or from the machine controller MS. If a request for a non-printing function is detected in step 31, the process moves to step 33 where the drive control SA identifies the printing unit 2.1–2.4 in which the function is to be executed. In step 35, the drive control SA signals the appropriate one or more of the clutch switches 23 in order to bring off-line the necessary rollers or cylinders of the selected printing unit. With the cylinders or rollers off-line, the drive control SA next calls an off-line routine from the program memory 11 for controlling the appropriate one of the localized drivers A.1–A.4 in step 37. In keeping with the invention, the routine in the program memory 11 provides the control signals to the selected one of the localized drivers A.1–A.4 for the purpose of completing the assigned function—e.g., pre-inking or producing a new printing form. When the drive controller SA has executed the routine and completed the assigned function, a signal is delivered to the appropriate one or more of the clutch switches 23 at step 39 in order to couple the appropriate one of the clutches K.1–K.4 so that the cylinders or rollers are brought back on-line with the main drive. Proper registration is assured using either the angle transmitter 13 or conventional mechanical means to key the coupling so that the off-line drive linkage return the cylinders on-line in exactly the right relationship with respect to the other cylinders.

From the foregoing is will be appreciated that the invention provides an apparatus and method for maintaining a high degree of synchronization between printing units, which provides a high degree of registration between the units, while at the same time providing maximum flexibility for operating each of the printing units independently in order to perform specialized tasks. Each of the references identified herein are hereby incorporated by reference.

We claim:

1. A drive for a sheet-fed offset printing machine, in which plate or form cylinders arranged in individual printing units of the machine are driven by a common train of gears, each of the plate or form cylinders is associated with a remotely actuable clutch and a controllable drive for driving the plate or form cylinder, and a drive control for controlling the controllable drives and clutches, wherein when the clutch is actuated, the plate or form cylinder is decoupled from the common gear train to be driven by the controllable drive and is exchangeable with a new plate or form cylinder, the remaining cylinders being driven by the common gear train.

2. The drive according to claim 1 wherein rollers of an inking and/or damping units are driven by the cylinders and each of the inking and/or damping units each has its own drive.

3. The drive according to claim 1 wherein each of the clutches associated with a cylinder is arranged in the drive train between a blanket cylinder and a plate or form cylinder.

4. The drive according to claim 1 wherein when the clutches have been actuated, the cylinders in all the printing units are driven by their associated drives to proceed with a plate or form cylinder exchange operation in all the printing units.

5. The drive according to claim 2 wherein when the clutches have been disengaged, the cylinders are driven by the controllable drives in conjunction with the rollers of the inking and/or damping units to run predetermined pre-inking and/or pre-damping programs.

6. The drive according to claim 1 wherein each of a plurality of printed image producing devices is assigned one of the cylinders, and when the clutches have been disengaged, the cylinders of each printing unit are driven in a manner intended to produce a new printing form.

7. The drive according to claim 1 wherein, when the clutches have been disengaged, the remaining cylinders are driven by the main drive for washing at least one of the cylinders or drums.

8. In a sheet-fed offset printing press having inking and/or dampening systems, a drive for plate or form cylinders of individual print units of the press, the drive comprising: a common gear mechanism powered by a main drive for driving all of the cylinders, a coupling and localized drive for one or more of the cylinders for at least one of the printing units, each of the localized drives and the couplings for one of the printing units have assigned to them an interactive drive control in communication with the main drive in order for the one or more cylinders of the printing unit to be disengaged from the main drive and brought on-line to the localized drive for automatically exchanging plate or form cylinders of the printing units when the coupling is disengaged while the remaining cylinders continue to be driven by the main drive.

9. The drive according to claim 8 wherein rollers of the inking and/or dampening systems are operated by way of the localized drives fitted to the respective cylinders.

10. The drive according to claim 8 wherein with the couplings disengaged, the cylinder is on line, rollers belonging to the inking and/or dampening systems are operated by the localized drives for conducting pre-inking and/or pre-dampening procedures.

11. The drive according to claim 8 wherein each of the cylinders has assigned to it image generation facilities; and when the couplings are in a disengaged state, the cylinder is brought on-line for the purpose of generating a new print form in the associated print unit.

12. The drive according to claim 8 wherein during, the couplings disengagement, the remaining cylinders are operated at least one at a time via the main drive.

* * * * *